United States Patent [19]

Sakurai

[11] Patent Number: 4,635,519

[45] Date of Patent: Jan. 13, 1987

[54] HYBRID ELECTRONIC MUSICAL INSTRUMENT

[75] Inventor: Keiichi Sakurai, Tokyo, Japan

[73] Assignee: Casio Computer Co., Ltd., Tokyo, Japan

[21] Appl. No.: 597,169

[22] Filed: Apr. 5, 1984

[30] Foreign Application Priority Data

Apr. 15, 1983 [JP] Japan ..... 58-65679
Apr. 30, 1983 [JP] Japan ..... 58-74916

[51] Int. Cl.[4] ..... G10H 3/06
[52] U.S. Cl. ..... 84/1.17; 84/1.03
[58] Field of Search ..... 84/1.01, 1.03, 1.17, 84/1.24, DIG. 22, 1.16

[56] References Cited

U.S. PATENT DOCUMENTS 4,038,897 8/1977 Murray et al. ..... 84/1.16
4,129,055 12/1978 Whittington et al. ..... 84/1.01
4,383,461 5/1983 Berkers ..... 84/1.03

FOREIGN PATENT DOCUMENTS 2837114 3/1980 Fed. Rep. of Germany .
3100934 1/1982 Fed. Rep. of Germany .

*Primary Examiner*—Forester W. Isen
*Attorney, Agent, or Firm*—Frishauf & Partners

[57] ABSTRACT

A key signal is supplied through an I/O port to a chord discriminating section of one electronic musical instrument, which generates corresponding accompaniment tone data. The accompaniment tone data is transferred through the I/O port to a tone signal generator of a different electronic musical instrument without autoplay accompaniment function, whereby accompaniment tone is generated from the different electronic musical instrument.

19 Claims, 10 Drawing Figures

FIG. 3

| OCTAVE | CODE |
|---|---|
| C1 | 0 0 |
| C2 | 0 1 |
| C3 | 1 0 |
| C4 | 1 1 |

FIG. 4

| TONE NAME | CODE |
|---|---|
| C | 0 0 0 0 |
| C# | 0 0 0 1 |
| D | 0 0 1 0 |
| D# | 0 0 1 1 |
| E | 0 1 0 0 |
| F | 0 1 0 1 |
| F# | 0 1 1 0 |
| G | 0 1 1 1 |
| G# | 1 0 0 0 |
| A | 1 0 0 1 |
| A# | 1 0 1 0 |
| B | 1 0 1 1 |

| TONE NAME | CODE |
|---|---|
| C2 | * 0 1 0 0 0 0 0 |
| C2# | * 0 1 0 0 0 0 1 |
| D2 | * 0 1 0 0 0 1 0 |
| D2# | * 0 1 0 0 0 1 1 |
| E2 | * 0 1 0 0 1 0 0 |
| F2 | * 0 1 0 0 1 0 1 |
| F2# | * 0 1 0 0 1 1 0 |
| G2 | * 0 1 0 0 1 1 1 |
| G2# | * 0 1 0 1 0 0 0 |
| A2 | * 0 1 0 1 0 1 1 |
| A2# | * 0 1 0 1 0 1 0 |
| B2 | * 0 1 0 1 0 1 1 |
| C3 | * 0 1 1 0 0 0 0 |
| C3# | * 0 1 1 0 0 0 1 |
| ⋮ | |
| G3# | * 0 1 1 1 0 0 0 |
| ⋮ | |
| B6 | * 1 1 0 1 0 1 1 |
| C7 | * 1 1 1 0 0 0 0 |

| | |
|---|---|
| SOUNDING AREA COMMAND | 0 |
| KEY DEPRESSION COMMAND | 1 |

HYBRID ELECTRONIC MUSICAL INSTRUMENT

BACKGROUND OF THE INVENTION

This invention relates to a hybrid electronic musical instrument which comprises two or more electronic musical instruments coupled together to provide expanded overall capability of functions.

Conventionally, two electronic keyboard musical instruments are arranged one above another for use as a two-stage electronic keyboard musical instrument. In this case, an electronic musical instrument for playing melody part is arranged as the upper stage and that for the accompaniment part as the lower stage. Of the two instruments, the one which has a greater number of play keys or has a greater number of available timbres for selection is used as the melody part instrument. Where an electronic musical instrument with an auto-play function of accompaniment is used for the two-stage musical instrument, it is used for the melody part of upper stage for the same reasons. Since the electronic musical instrument with auto-play function of accompaniment and other greater number of functions such as rhythm function is used as an upper stage instrument, the upper stage instrument has to be operated for obtaining auto-play accompaniment. Usually, however, the lower instrument is operative for the auto-play accompaniment, and users are not familiar with the upper stage instrument operative for auto-play accompaniment.

SUMMARY OF THE INVENTION

An object of the invention is to provide a hybrid electronic musical instrument comprising two or more electronic musical instruments connected together, in which at least one function of an electronic musical instrument can be shared on another electronic musical instrument, so that the two or more electronic musical instruments are used as a single electronic musical instrument with operatively integrated functions.

According to the invention, there is provided a hybrid electronic musical instrument, which comprises a first electronic musical instrument with circuit means for executing a predetermined function and a second electronic musical instrument without such circuit means, the second electronic musical instrument including means for providing a drive signal for driving the circuit means in the first electronic musical instrument and means for supplying the provided drive signal to the circuit means of the first electronic musical instrument, the first electronic musical instrument including means for supplying a signal for executing the predetermined function provided from the circuit means to the second electronic musical instrument according to the drive signal.

BRIEF DESCRIPTION OF THE DRAWINGS

FIGS. 3 and 4 are views showing octave code data and note code data generated by key operation on keyboards shown in FIG. 1;

DETAILED DESCRIPTION OF THE PREFERRED EMBODIMENTS

Figure 1:
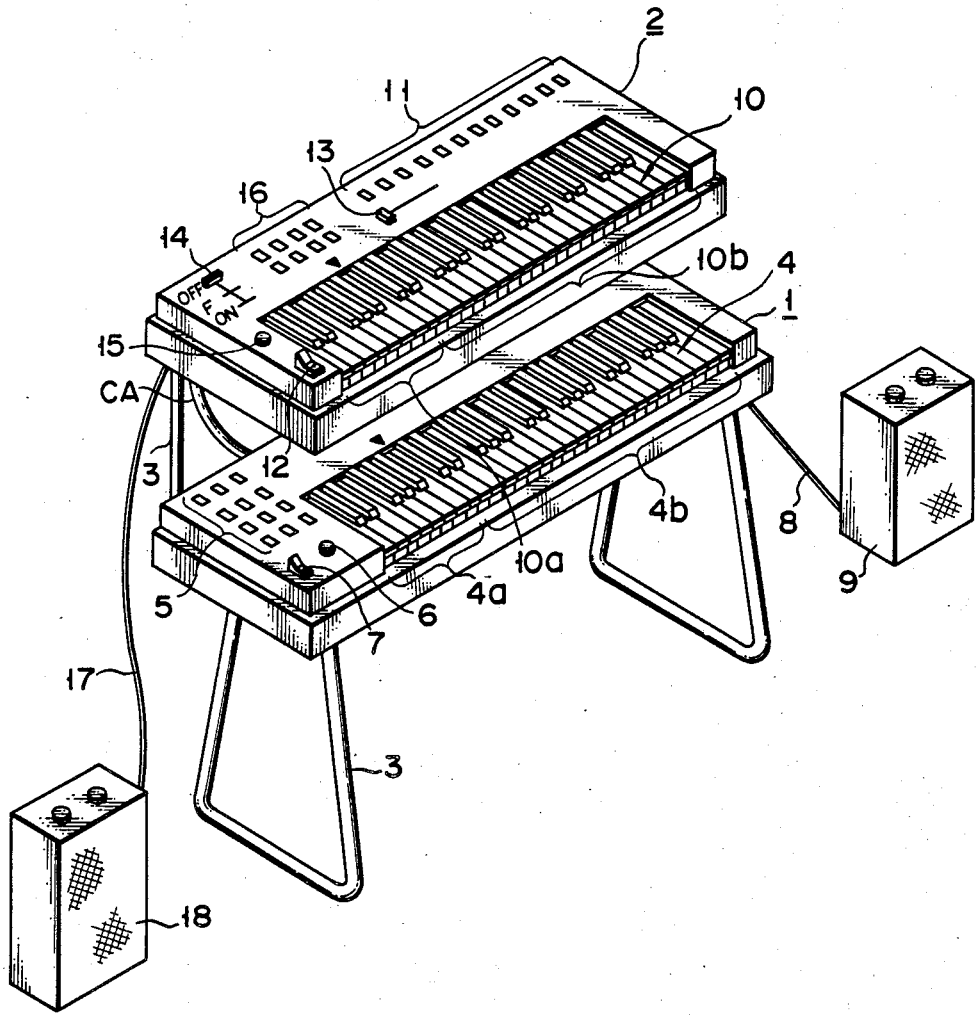
FIG. 1 is a perspective view showing an embodiment of the invention.

FIG. 1 shows one embodiment of the hybrid electronic musical instrument according to the invention. Two electronic keyboard musical instruments 1 and 2 are supported one above another by a stand 3 and constitute a two-stage electronic keyboard musical instrument. The lower electronic musical instrument 1 does not have any auto-play accompaniment function, while the upper electronic musical instrument 2 has an auto-play accompaniment function. The two instruments are coupled together by a cable CA. External loudspeakers 9 and 18 are connected by cables 8 and 17 to the respective instruments 1 and 2.

The lower electronic musical instrument 1 has a 4-octave keyboard 4 consisting of two key groups 4*a* and 4*b*. It also has a timbre switch section 5 consisting of 12 switches provided at a position on the upper left side of the key groups 4*a* and 4*b*. The section 5 permits switching of timbres of the played tone such as piano, flute, violin, etc. The instrument 1 further has a volume control knob 6 for controlling the volume of musical sound produced and a power switch 7, the knob 6 and switch 7 being provided at the left lower corner part of the instrument panel. The loudspeaker 9 connected via the cable 8 to the instrument 1, as mentioned earlier, contains an amplifier for amplifying tone signals generated by operation of the key groups 4*a* and 4*b*.

The upper electronic musical instrument 2, like the lower instrument 1, has a 4-octave keyboard 10 consisting of two key groups 10*a* and 10*b*. It also has a timbre switch group 11 provided at the upper right part of its panel, a power switch 12 provided at the left lower corner part and a main volume control lever 13 at the center upper part. It further has an auto-play accompaniment switch 14 at left upper corner part of the panel, a system changoever switch 15 provided at the left end and a rhythm switch section 16 provided at the left upper part. The auto-play accompaniment switch 14 can switch an "off" mode, a "finger" mode and an "on" mode. In its "off" mode position (OFF), the entire key groups 10*a* and 10*b* may be used for usual melody play without auto-play accompaniment. In its "finger" mode position (F), auto-play accompaniment chords corresponding to operated keys on the low octave side key group 10*a* can be produced on rhythm. In the "on" mode position (ON), auto-play accompaniment chords can be provided on rhythm as designated by operating the low octave side key group 10*a* with one, two or three fingers. The system changeover switch 15 is provided for chord designation for providing auto-play accompaniment with the key group 4*a* of the electronic musical instrument 1. The rhythm switch section 16 has 8 switches for respective rhythm patterns, e.g., rock, disco, waltz.

The upper electronic musical instrument 2 has various functions which are not provided in the lower electronic musical instrument 1. It is connected to the loudspeaker 18 with built-in amplifier through the cable 17.

Figure 2:
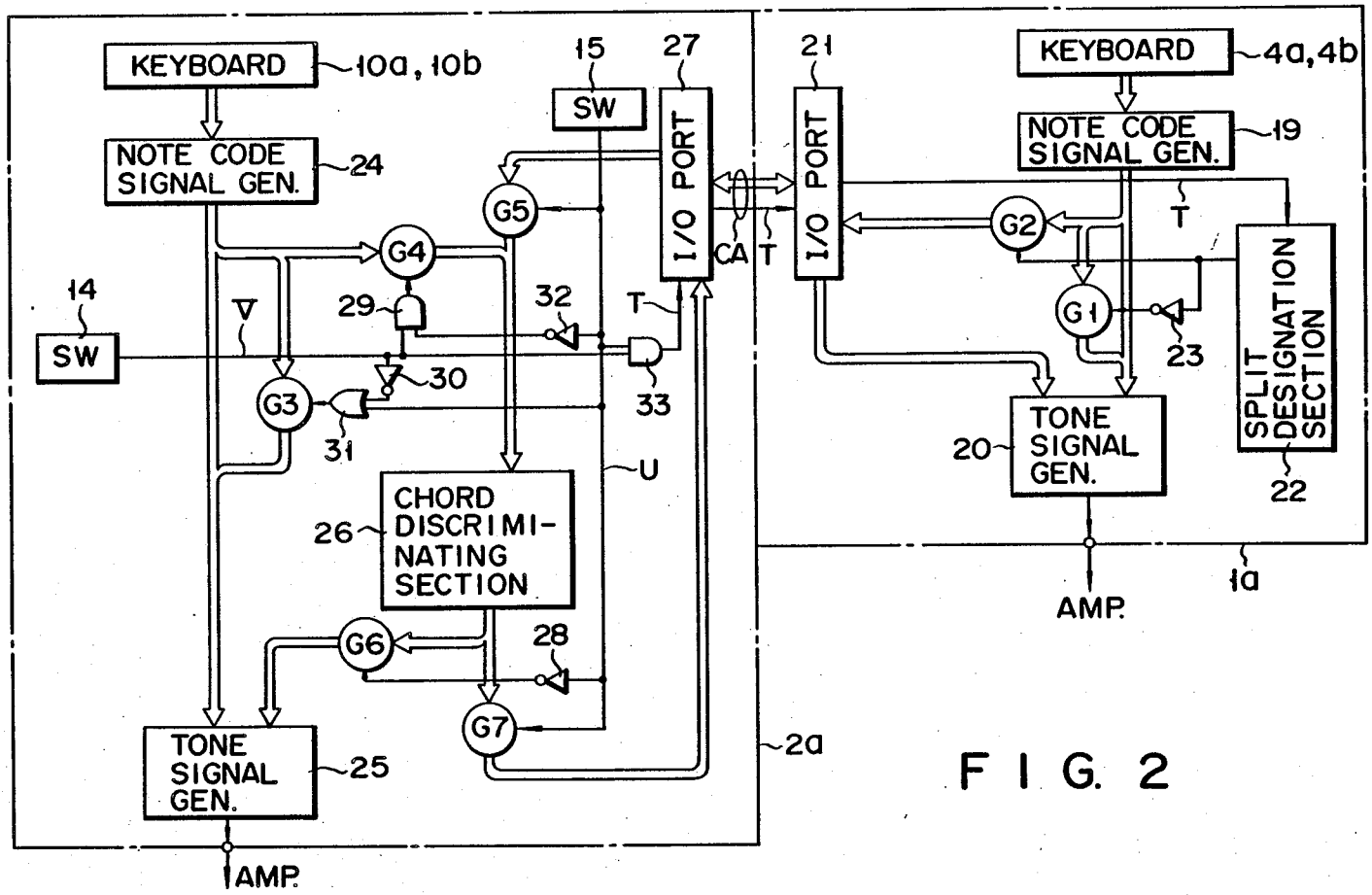
FIG. 2 is a block diagram outlining the circuit system of the embodiment of FIG. 1.

The main circuits 1*a* and 2*a* of both the electronic musical instruments 1 and 2 will now be described with reference to FIG. 2. The key groups 4*a* and 4*b* of the electronic musical instrument 1 are connected to a note code signal generator 19. The note code signal generator 19 receives note code signals produced with operation of keys on the key groups 4*a* and 4*b* and generates 6-bit note codes under the control of a CPU (not shown). FIGS. 3 and 4 show note data. Each note code data consists of 4-bit data of "0000" to "1011" repesenting 12 corresponding notes in each octave as shown in FIG. 4 and 2-bit data of "00" to "11" representing corresponding octaves of the 4-octave keyboard from the low octave to high octave side as shown in FIG. 3. The respective octaves are typically shown by the notes $C_1$ to $C_4$. A note code signal generator 24 also generates the same note code data when the keys on the key groups 10*a* and 10*b* of the electronic musical instrument 2 are operated. The note code signal generated by key operation on the lower side key group 4*a* which covers the lowest octave among the octaves covered by the key groups 4*a* and 4*b*, is fed through a gate $G_1$ to a tone signal generator 20 and also fed through a gate $G_2$ to an I/O (input/output) port 21. Note code signals generated from the other key group 4*b* are fed directly to the tone signal generaor 20. Accompaniment chord signals transferred from the instrument 2 through the I/O port 21, as will be described later, are also fed to the tone signal generator 20. The tone signal generator 20 generates a tone signal according to the input signals, the tone signal generated being coupled through an amplifier (not shown) to a loudspeaker 9 to be sounded.

A transfer control signal T transferred from the electronic musical instrument 2, to be described later, is fed to the I/O port 21 and then to a split designating section 22. The output signal from the split designating section 22 is fed through an inverter 23 to the gate $G_1$ and also fed directly to the gate $G_2$, thus on-off controlling the gates $G_1$ and $G_2$.

The key groups 10*a* and 10*b* of the electronic musical instrument 2 are connected to a note code signal generator 24 like the case of the electronic musical instrument 1. Note code signals generated by key operation on the low octave side key group 10*a* are fed from the note code signal generator 24 through a gate $G_3$ to a tone signal generator 25 and also fed through a gate $G_4$ to a chord discriminating section 26. Note code signals from the other key group 10*b* are directly fed to the tone signal generator 25. Accompaniment chord signals transferred from the chord discriminating section 26 through the gate $G_6$ are also fed to the tone signal generator 25. The tone signal generator 25 generates a tone signal according to the input signals noted, the tone signal being coupled through an amplifier (not shown) to the loudspeaker 18. The chord discriminating section 26 includes of a ROM, for instance.

Note code signals transferred from the I/O port 21 of the electronic musical instrument 1 and I/O port 27 of the electronic musical instrument 2 through a gate $G_5$ are also fed to the chord discriminating section 26. The chord discriminating section 26 generates a chord according to these note code signals, the chord generated being fed as accompaniment code data through a gate $G_6$ to the tone signal generator 25. The chord generated is also fed through a gate $G_7$ and I/O ports 27 and 21 to the tone signal generator 20 of the electronic musical instrument 1.

Signal U provided from the system changeover switch 15 is fed directly to the gates $G_5$ and $G_7$ and also fed through an inverter 28 to the gage $G_6$, thus on-off controlling the gates $G_5$, $G_6$ and $G_7$. A signal V which is provided from the auto-play accompaniment switch 14 is fed to an AND gate 29 and also fed through an inverter 30 to an OR gate 31. The output signal U of the switch section 15 is fed through an inverter 32 to the AND gate 29 and also fed directly to the OR gate 31. The outputs of the AND gate 29 and OR gate 31 are fed as on-off control signal to the gates $G_4$ and $G_3$.

The output signals U and V of the switch sections 14 and 15 are further fed to an AND gate 33, and the output of the gate 33 is fed as the transfer control signal T noted above through the I/O ports 27 and 21 to the split designating section 22.

Data and control signals T are transferred between the I/O ports 21 and 27 via the cable CA.

The operation of the embodiment having the above construction will now be described.

At least one of the keys of the electronic musical instrument 1 is imparted with a function of causing auto-play accompaniment of the electronic musical instrument 2 by the following operation.

With the auto-play accompaniment switch 14 in its "finger" mode or "on" mode position the system switch 15 is turned on, thus changing the output of the switch 15 to "1" (representing a high binary logic level). Since the output of the switch 14 is already "1", transfer control signal T of "1" is provided from the AND gate 33 to be fed to the split designating section 22. The split designating section 22 feeds a signal "1" to the gate $G_2$ to enable the same. It is also fed through the inverter 23 to the gate $G_1$ to disable the same. The note code data provided by key operation on the low octave side 1-octave key group 4*a* of the electronic musical instrument 1 is fed through the I/O ports 21 and 27 and gate $G_5$ to the chord discriminating section 26. The chord discriminating section 26 generates accompaniment chord signals according to the note code signals, to be fed through the gate $G_7$ and I/O ports 27 and 21 to the tone generating section 20 and then fed as accompaniment chord signals to the loudspeaker 9 for sounding.

Thus, auto-play accompaniment can be performed with the key group 4*a* of the instrument 1. The gates $G_5$ and $G_7$ are enabled when the system switch 15 is turned on.

With the system switch 15 turned on, the OR gate 31 provides output "1" to enable the gate $G_3$, whereby all the note code signals provided by key operation on the key groups 10*a* and 10*b* are directly fed to the tone signal generator 25. Thus, it is possible to obtain only manual melody play with the electronic musical instrument 2. Meanwhile, the note code signals from the key group 4*b* of the electronic musical instrument 1 are fed to the tone signal generator 20, so that only manual melody play is possible with the key group 4*b*.

With the system switch 15 turned off and auto-play accompaniment switch 14 turned on, the AND gate 33 is disabled to provide transfer control signal T of "0" (a low binary logic level). The split designating section 22 thus provides an output "0" to the gate $G_2$ to disable the same while enabling the gate $G_1$. Thus, note code signals provided by key operation on the key groups 4*a* and 4*b* are all fed to the tone signal generator 20. Only manual melody play is thus made possible with the key groups 4a and 4b. Meanwhile, with the system switch 15 turned off and auto-play accompaniment switch 14 turned on, the gates $G_3$ and $G_5$ are disabled while the gate $G_4$ is enabled. Also, the gate $G_7$ is disabled while the gate $G_6$ is enabled. Thus, the note code signals from the key group 10a are fed through the gate $G_4$ to the chord discriminating section 26 while accompaniment chord signals are fed through the gate $G_6$ to the tone signal generator 25, and note code signals from the key group 10b are fed directly to the tone signal generator 25. Auto-play accompaniment is thus made possible with the key group 10a while the manual melody play is made possible with the key group 10b.

With the auto-play accompaniment switch 14 turned off, the AND gate 33 is disabled regardless of whether the system switch 15 is "on" or "off". The note code signals from the key group 4a of the electronic musical instrument 1 thus are not transferred to the chord discriminating section 26 of the electronic musical instrument 2, so that only manual melody play is made possible with the key groups 4a and 4b. Meanwhile, with the auto-play accompaniment switch 14 turned off, the gate $G_4$ is disabled while the gate $G_3$ is enabled, so that the note code signals from the key groups 10a and 10b are all fed to the tone signal generator 25. Thus, like the electronic musical instrument 1, only manual melody play is made possible with the key groups 10a and 10b.

In the above embodiment, the accompaniment chord signal provided from the chord discriminating section 26 of the electronic musical instrument 2 with auto-play accompaniment function is transferred to the electronic musical instrument 1 without auto-play accompaniment function, so that accompaniment chord is produced in the electronic musical instrument 1. However it is possible to produce the accompaniment chord data in the electronic musical instrument 2 without transferring the accompaniment chord signal.

Further, while in the above embodiment two electronic musical instruments are connected together, it is possible to connect together three or more electronic musical instruments such that a predetermined function of at least one electronic musical instrument with auto-play accompaniment circuit means may be shared on the other electronic musical instruments.

As has been shown, a predetermined function of one electronic musical instrument may be shared on the other electronic musical instruments so that the freedom of play can be enhanced.

Additionally, since the function of providing auto-play accompaniment in the electronic musical instrument with auto-play accompaniment circuit means can be shifted to at least one of the keys of other electronic musical instruments without auto-play accompaniment circuit means, the position of keys for providing auto-play accompaniment may be moved to a position convenient to the player. A plurality of electronic musical instruments thus can be connected such that a condition convenient for play can be brought about.

Further, in the above embodiment melody and accompaniment tones generated from the electronic musical instrument 1 are sounded only from the loudspeaker 9, while the tones generated from the other electronic musical instrument 2 are sounded only from the other loudspeaker 18. For stereophonic play, the tone signals obtained from the tone signal generator 20 may be coupled through a pan-pot circuit (not shown) to the two loudspeakers 9 and 18.

Further the loudspeakers 9 and 18 having inner amplifiers therein may be provided in the case of the electronic musical instruments 1 and 2.

A different embodiment of the invention will now be described with reference to FIGS. 5 through 10. In the Figures, parts corresponding to those in FIGS. 1 through 2B are designated like reference numerals.

Figures 5, 7, 8:
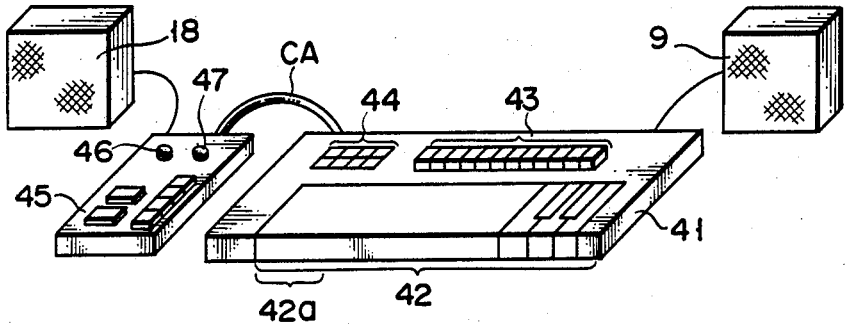
FIG. 5 is a perspective view showing a different embodiment of the invention.
FIGS. 7 and 8 are views showing note code data and command data generated by key operation on a keyboard shown in FIG. 5.

Referring to FIG. 5, there is shown an electronic musical instrument 41, which has a 61-key keyboard 42 provided on a top fron part, which consists of keys for the second octave note $C_2$ to the seventh octave note $C_7$. On the rear side of the keyboard 42 there are provided a timbre designation switch section 43 for designating various timbres, e.g., piano, violin, guitar, etc. and an effect switch section 44 for providing various effects, e.g., vibrato, sustain, etc. A loudspeaker 9 with an amplifier 9a is connected to the electronic musical instrument 41, and melody tones, etc. generated by operating the keyboard 42 are sounded through the loudspeaker 9. The loudspeaker 9 with the amplifier 9a may be provided in the electronic musical instrument 41.

An accompaniment unit 45 is connected to the electronic musical instrument 41 through the cable CA. It has an accompaniment pattern designation switch 46 and a chord switch 47. The accompaniment pattern designation switch 46 can switch an "off" mode, a "finger" mode and a "one finger" mode. In its "off" mode position, the entire keyboard 42 is operative for manual play without auto-play accompaniment. In its "finger" mode, a particular lower side part of the keyboard 42, e.g., one octave keys 42a, constitutes an accompaniment keyboard, and auto-play accompaniment can be obtained when the keyboard part is depressed with the left hand. In the "one finger" mode, auto-play accompaniment chord maj is designated by depressing one key on the accompaniment keyboard 42a, chord min is designated by simultaneously depressing two keys, and chord 7th is desingated by simultaneously depressing three keys. The chord switch 47 can switch a continuous mode, a rhythmic mode and an arpeggio mode. In the continuous mode, only bass of the auto-play accompaniment is interlocked to rhythm. In the rhythmic mode, both chord and bass of auto-play accompaniment are interlocked to rhythm. In arpeggio mode, arpeggio is added to the rhythmic mode accompaniment. A loudspeaker 18 with an inner amplifier 18a is connected to the accompaniment unit 45. Both rhythm and accompaniment are sounded from the loudspeaker 18. The loudspeaker 18 with the inner amplifier 18a may be provided in the accompaniment unit 45.

The circuits of the electronic musical instrument 41 and accompaniment unit 45 will now be described with reference to FIG. 6. When modes are switched by the accompaniment pattern designation switch 46 of the accompaniment unit 45, an accompaniment pattern detector 52 detects this and generates a mode switching signal which is fed to a chord discriminator 53 and a sounding area generator 54. When the mode switching signal represents the finger mode or one finger mode, the sounding area generator 54 feeds, for instance, a note code $G_3$# which is a sounding area data to a command generator 55. The sounding area data is provided for alloting the key group 42a lower than note $G_3$# of the keyboard 42 for the accompaniment.

An I/O port 56 includes a receiving circuit 57, which receives key operation signals transferred from the electronic musical instrument 41 and feeds it to a command decoder 58. The command decoder 58 decodes the key operation signals and feeds the decoded data to a key operation pattern generator 59. The key operation pattern generator 59 generates key operation pattern data from one or more key operation signals. The data thus generated is fed to the chord discriminator 53.

The chord discriminator 53 consists of a ROM, for instance, which has a finger mode memory area and a one finger mode memory area. These areas are designated when the mode switching signal from the accompaniment pattern detector 52 represents the finger mode and one finger mode, respectively. No area is designated when the mode switching signal represents the "off" mode. According to the key operation pattern data from the key operation pattern generator 59, chord data is read out from the chord discriminator 53 and fed to an obbligato pattern generator 60, a chord pattern generator 61, a bass pattern generator 62 and an arpeggio pattern generator 63. Of these pattern generators, the chord, bass and arpeggio pattern generators 61, 62 and 63 are driven according to the mode provided by the chord switch 47, whereby accompaniment tone signals are generated from a chord signal or tone generator 64, a bass signal or tone generator 65 and an arpeggio signal or tone generator 66 and fed to a mixer 67. The mixer 67 mixes the input accompaniment tone signals to produce a single signal, which is amplified by an amplifier 18*a* to be sounded from the loudspeaker 18.

The obbligato pattern generator 60 feeds obbligato pattern data to the command generator 55 according to chord signal from the chord discriminator 53. The command generator 55 adds to the obbligato pattern data an upper bit of "1" (a high binary logic level), as shown in FIG. 8, indicating that the data is a key depression data, while it adds to the obligate pattern data an upper bit of "0" (a low binary logic level), as shown in FIG. 8, indicating that the data is a sounding area data. These data are transferred from the transmitting circuit 68 through a cable CA to a receiving circuit 70 in the I/O port 69 of the electronic musical instrument 41.

The receiving circuit 70 in the electronic musical instrument 41 feeds the received data to command decoder 71. The command decoder 71 decodes the most significant bit (MSB) of each data and, if the bit is "1", indicative of the key depression data, it feeds the data to a melody signal or tone generator 72. If the MSB is "0", indicative of sounding area data, it feeds the data to a sounding area memory 73.

Key operation on the keyboard 42 is detected by a key operation detector 74 under the control of a CPU (not shown). The key operation detector 74 generates 8-bit key operation data shown in FIG. 7. In the Figure, the MSB indicated at "*" is "0" when key is "on" and "1" when key is "off". The key operation data is fed to a comparator 75, and also it is fed to a command generator 76, which adds the key depression command data "1" as an MSB, shown in FIG. 8, to the data which is fed through a transmitting circuit 77 in the I/O port 69 and cable CA to the receiving circuit 57 in the accompaniment unit 45.

The data in the sounding area memory 75 is fed to the comparator 73. Of the key operation dta, only those having greater values than that of the data from the sounding area memory 73, i.e., only those on the higher note side, are fed to the melody tone generator 72. Data from an effective timbre detector 78, which detects a key-"on" operation of the timbre select switch section 43 and effect switch section 44, is fed to the melody tone generator 72. According to this data and also to the obbligato data and key operation data noted above, the melody tone generator 72 generates a melody tone signal which is amplified by the amplifier 9*a* and sounded from the loudspeaker 9.

The operation of this embodiment having the above construction will now be described.

When the accompaniment pattern designation switch 46 is in the "off" mode position, the "off" mode data from the accompaniment pattern detector 52 is supplied to the sounding area generator 54, so that no signal is fed to the command generator 55. That is, no signal is fed through the command generator 55, transmitting circuit 68, receiving circuit 70 and command decoder 71 to the sounding area memory 73. For this reason, data in the sounding area memory 73 is "0", and key operation data fed from the key operation detector 74 to the comparator 75 is all transferred to the melody tone generator 72 to generate a corresponding melody tone signal which is amplified and sounded. Thus, manual play is made possible with the whole keyboard 42. At this time, the key operation data is fed through the command generator 76, transmitting circuit 77, receiving circuit 57 and command decoder 58 to the key operation pattern generator 59 for converting to key depression pattern data which is fed to the chord discriminator 53. Since the "off" mode data is fed from the accompaniment pattern detector 52 to it, the chord discriminator 53 provides no signal, so that no accompaniment is provided from the accompaniment unit 45.

When the accompaniment pattern designation switch 46 is switched to the "finger" mode position, "finger" mode data is fed from the accompaniment pattern detector 52 to the sounding area generator 54. Thus, the sounding area data, i.e., data "*0111000" (bit "*" being "0" when key is "on" and "1" when key is "off") representing the note $G_3$#, is fed to the command generator 55. The command generator 55 adds the sounding area command "0", shown in FIG. 8, as an MSB to the data "*0111000" for the note $G_3$# and feeds the resultant data through the transmitting circuit 68 and receiving circuit 70 to the command decoder 71. The command decoder 71 decides that the MSB of the data is "0", so that the data "*0111000" for $G_3$# is written in the sounding area memory 73.

When the keys for $C_2$, $E_2$, $G_2$ and $F_4$ on the keyboard 42 are simultaneously depressed, the key operation detector 74 feeds key operation data "*0100000", "*0100100", "*0100111" and "*1000101" to the comparator 75. The comparator 75 compares the value of the key depression data except for the MSB of "*" and the data for the note $G_3$# except for the MSB of "*" supplied from the sounding area memory 73. As a result, the higher value data for the note $F_4$ is supplied to the melody tone generator 72, which thus generates a tone signal with a predetermined effect provided according to the data from the effective timbre detector 78, the tone signal generated being amplified and sounded from the loudspeaker 9.

With the sounding area data from the accompaniment unit 45 supplied to the playing unit 41, only notes higher than note $G_3$# are sounded as melody play tones from the electronic musical instrument 41.

The key operation data for notes $C_2$, $E_2$, $G_2$ and $F_4$ are fed through command generator 76, transmitting circuit 77, receiving circuit 57 and command decoder 58 to the key operation pattern generator 59 for converting to key operation pattern data which is fed to the chord discriminator 53. Since the chord discriminator 53 is functioning with "finger" mode data supplied from the accompaniment pattern detector 52, it determines $C_{maj}$ chord from the key depression pattern data $C_2$, $E_2$ and $G_2$. The chord data for $C_{maj}$ is fed to the obbligato pattern generator 60, chord pattern generator 61, bass pattern generator 62 and arpeggio pattern generator 63. The chord, bass and arpeggio pattern generators 61, 62 and 63 generate respective pattern data according to the state of the chord switch 47. These pattern data are respectively fed to the chord, bass and arpeggio tone sources 64, 65 and 66, which generate respective tone signals which are mixed by the mixer 67 to produce a single tone signal to be amplified and sounded from the loudspeaker 18.

With the key operation data thus transferred from the electronic musical instrument 41 to the accompaniment unit 45, only the note code signals from the keys of the low octave side key group 42*a* lower than $G_3$# of the keyboard 42, are sounded as accompaniment tones from the accompaniment unit 45. In this way, the keyboard 42 is functionally divided into the high octave side key group for melody play and low octave side key group for accompaniment.

According to the chord data for $C_{maj}$ noted above, the obbligato pattern generator 60 feeds obbligato pattern data, i.e., data "*0110111" for $G_3$ and "*1000000" for $C_4$ to the command generator 55. The command generator 55 adds the key depression command "1" shown in FIG. 8 as an MSB to the data for $G_3$ and $G_4$, the result being fed through the transmitting circuit 68, receiving circuit 70 and command decoder 71. The command decoder 71 decides that the MSB of the data is "1" and feeds the data for $G_3$ and $G_4$ to the melody tone source 72. The melody tone generator 72 generates a tone according to the data from the effective timbre detector 78, the generated tone being fed as an obbligato tone along with the melody tone noted above for amplification and sounding from the loudspeaker 9.

With the obbligato pattern data generated according to the key operation data from the keyboard 42 and fed from the accompaniment unit 45 to the playing unit 41, the obbigato tone is sounded from the playing unit 41.

When the accompaniment pattern designation switch 46 is switched to the "one finger" position, "one finger" mode data is fed to the chord discriminator 53 from the accompaniment pattern detector 52 so that the "one finger" mode area in the ROM is designated. When three keys for $C_2$, $E_2$ and $G_2$ on the accompaniment key group 42*a* of the keyboard 42, for instance, are depressed, chord data of $C_{7th}$ with $C_2$ as root is produced for auto-play accompaniment as in the case of the "finger" mode noted above.

Figure 6:
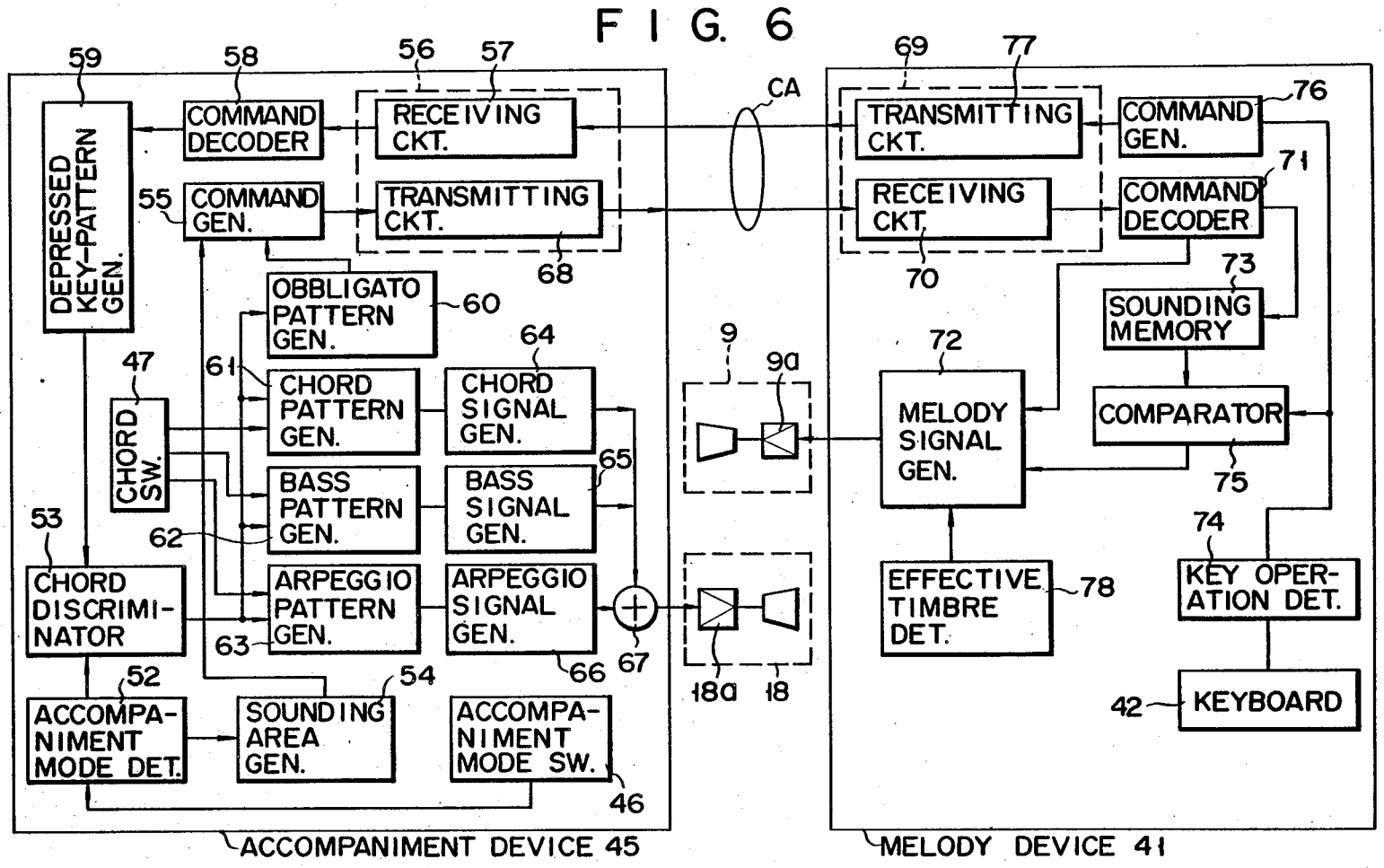
FIG. 6 is a block diagram showing the circuit system of the embodiment of FIG. 5.
Figure 9:
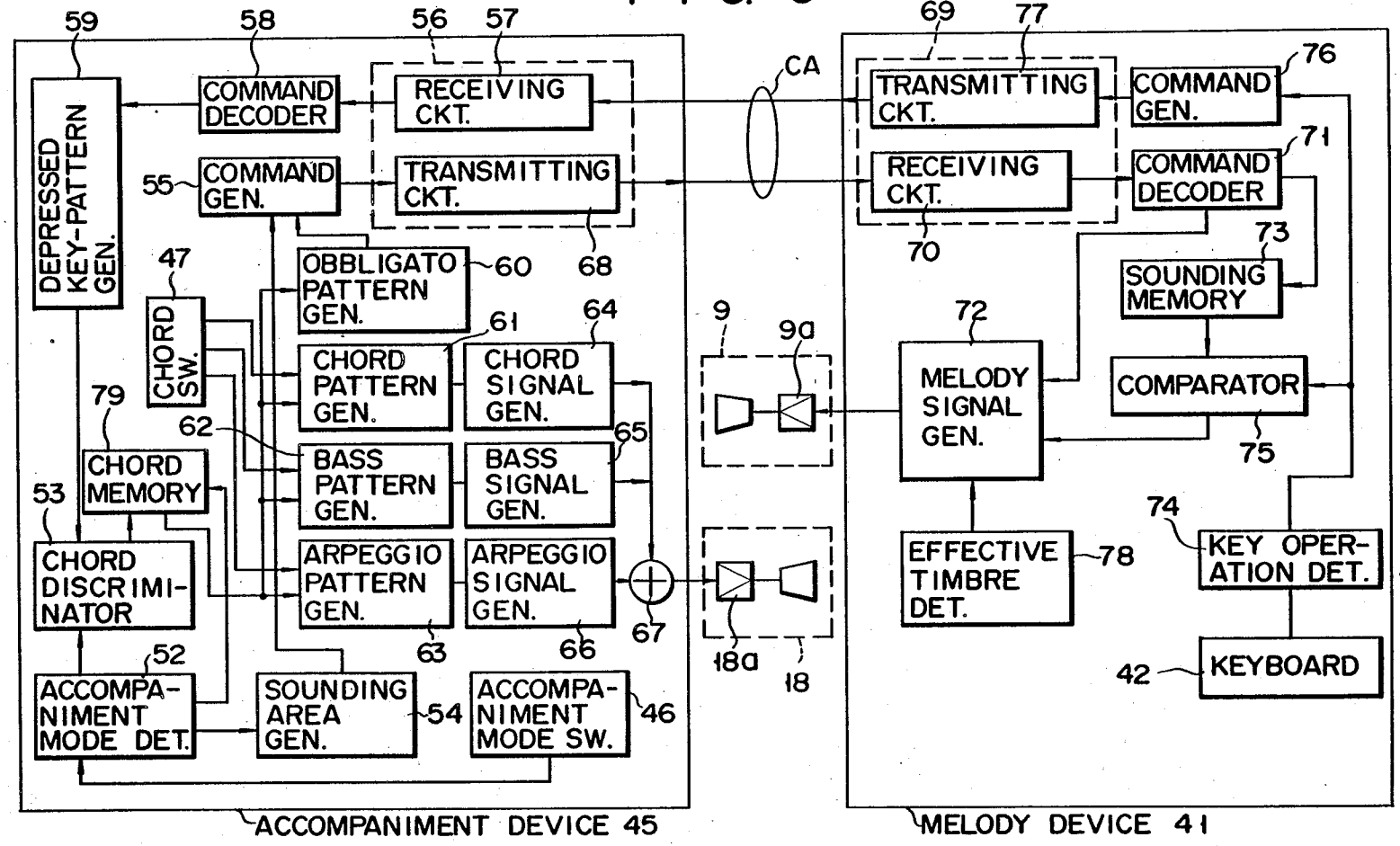
FIG. 9 is a block diagram showing a further embodiment of the invention.

FIG. 9 shows a modification of the embodiment of FIG. 6. In the Figure, like parts are designated by like reference numerals. In this modification, a chord memory 79 is provided between chord discriminator 53 and generators 60, 61, 62 and 63. The chord memory 79 feeds the chord signal from the chord discriminator 53 to the arpeggio pattern generator 63, etc. while also storing it. Once a play of a music is ended, the data stored in the chord memory 79 is then provided for auto-play accompaniment. The player may thus only play melody with the electronic musical instrument 41, which is convenient when exercising melody only. The rest of the modification is the same as the embodiment of FIG. 6.

Figure 10:
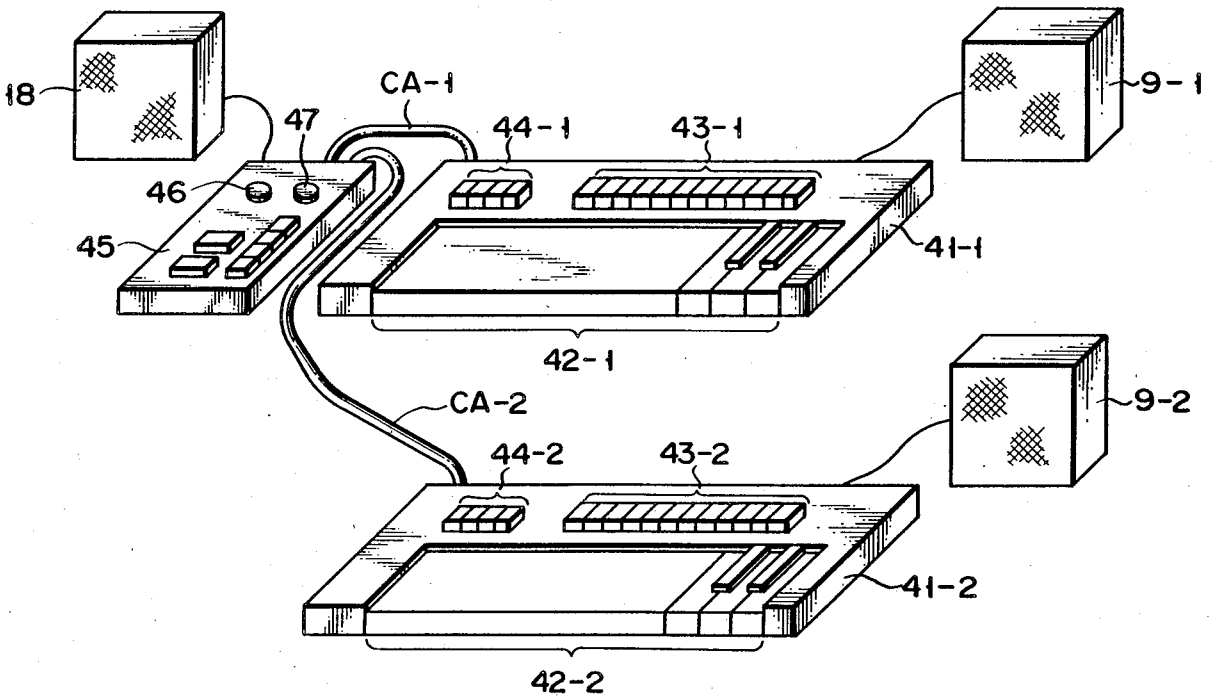
FIG. 10 is a perspective view showing a further embodiment of the invention.

FIG. 10 shows a further embodiment of the invention. In this embodiment, two electronic musical instruments 41-1 and 41-2 are used as a two-stage keyboard unit with an accompaniment unit 45, which has a plurality of input/output terminals for connection of cables CA-1, CA-2. The upper keyboard 42-1 is set to provide harpsichord timbre, while the lower keyboard 42-2 is set to provide cembaro timbre. With the electronic musical instrument 41-2 provided in addition to the electronic musical instrument 41-1 and accompaniment unit 45, it is possible to enjoy richer variety of play.

In this embodiment plural electronic musical instruments 41-1 and 41-2 are connected to the accompaniment unit 45, but it is also possible to connect a plurality of accompaniment units to a single electronic musical instrument.

Further, in the above embodiments accompaniment tone and obbligato tone are mutually controlled between the electronic musical instrument 41 and accompaniment unit 45, various other function controls are possible, e.g., permitting designation of timbres such as piano, violin, etc. for the electronic musical instrument 41 through the designation of rhythm such as march and waltz in the accompaniment unit 45 or desingation of chord such as chord, bass arpeggio for the accompaniment unit 45.

As has been described in the foregoing, in the embodiment the electronic musical instrument and accompaniment unit are provided independently and also for controlling one another. The electronic musical instrument and accompaniment unit thus can be purchased separately. For example, only the electronic musical instrument may be purchased first, and the accompaniment unit may be purchased later. Further, additional electronic musical instruments and accompaniment units having new functions may be readily provided to increase the variety of functions. Furthermore, since various electronic musical instruments and accompaniment units can be provided, the user may select a combination of electronic musical instrument and accompaniment unit as desired. Therefore, the electronic musical instrument and accompaniment unit can be fabricated independently.

What is claimed is:

1. A hybrid electronic material instrument, comprising:

a first electronic musical instrument including a first keyboard and circuit means for executing a predetermined function according to operation of said first keyboard; and a second electronic musical instrument without said circuit means;

said second electronic musical instrument including:

a second keyboard;

means for generating a drive signal by operating a key on said second keyboard for driving said circuit means in said first electronic musical instrument; and means for supplying said drive signal to said circuit means of said first electronic musical instrument; and said first electronic musical instrument including:

means for supplying a signal obtained by the execution of said predetermined function by said circuit means according to said drive signal, to said second electronic musical instrument.

2. A hybrid electronic musical instrument, comprising:

a first keyboard electronic musical instrument including a keyboard and auto-play accompaniment circuit means for automatically generating accompaniment tones according to the operation of at least one key of said keyboard;

a second keyboard electronic musical instrument without said auto-play accompaniment circuit means;

said auto-play accompaniment circuit means of said first keyboard electronic musical instrument including means for generating an accompaniment tone signal according to a key signal produced when at least one key of a keyboard of said second electronic musical instrument is operated; and said second keyboard electronic musical instrument including means for generating auto-play accompaniment tones according to said accompaniment tone signal.

3. The hybrid electronic musical instrument according to claim 2, which further includes:

system switching means provided on either one of said first and second keyboard electronic musical instruments; and means for supplying a key signal from said second keyboard electronic musical instrument to said auto-play accompaniment circuit means of said first keyboard electronic musical instrument according to an output of said system switching means.

4. The hybrid electronic musical instrument according to claim 3, which further comprises means for supplying said accompaniment tone signal to tone signal generating means in said second keyboard electronic musical instrument.

5. The hybrid electronic musical instrument according to claim 3, wherein said first keyboard electronic musical instrument includes:

accompaniment mode switching means;

means for generating a transfer control signal according to the output of said mode switching means and the output of said system switching means; and first gate means gate controlled according to said transfer control signal for supplying the key signal from said second keyboard electronic musical instrument to said auto-play accompaniment circuit means of said first keyboard electronic musical instrument.

6. The hybrid electronic musical instrument according to claim 5, wherein said second keyboard electronic musical instrument includes:

means for receiving the transfer control signal from said first keyboard electronic musical instrument;

means for generating a split designation signal in response to said transfer control signal; and second gate means gate controlled according to said split designation signal for supplying said key signal to said first keyboard electronic musical instrument.

7. The hybrid electronic musical instrument according to claim 3, wherein said auto-play accompaniment circuit means includes chord discriminating means for discriminating a chord represented by said key signal and generating a predetermined accompaniment tone signal.

8. The hybrid electronic musical instrument according to claim 7, wherein said chord discriminating means includes a ROM accessed by said key signal.

9. A hybrid electronic musical instrument, comprising:

a keyboard electronic musical instrument and an accompaniment unit connected thereto by a cable, wherein:

said keyboard electronic musical instrument includes a keyboard and means for generating a control signal to be supplied to said accompaniment unit, said control signal generating means including means for generating key depression data according to a key operation on the keyboard, means for supplying said key depression data to said accompaniment unit; and said accompaniment unit includes means for receiving said key depression data, means for generating key depression pattern data according to said received key depression data, means for discriminating a chord according to said key depression pattern data, means for generating accompaniment data designating a predetermined accompaniment tone according to the discriminated chord, accompaniment mode switching means, means for generating command data according to the output of said switching means, and means for supplying said command data to said keyboard electronic musical instrument;

and wherein said keyboard electronic musical instrument also includes means for designating on said keyboard a melody sounding area and an accompaniment sounding area according to said command data from said generating means of said accompaniment unit.

10. The hybrid electronic musical instrument according to claim 9, wherein:

said accompaniment unit is provided separately from said keyboard electronic musical instrument; and said chord discriminating means includes a ROM accessed by said key depression pattern data to generate predetermined accompaniment pattern data.

11. The hybrid electronic musical instrument according to claim 9, wherein:

said accompaniment unit is provided separately from said keyboard electronic musical instrument; and said chord discriminating means includes a chord memory connected to an output terminal of said chord discriminating means for progressively storing chord data discriminated by said chord discriminating means.

12. The hybrid electronic musical instrument according to claim 9, wherein:

said instrument comprises first and second keyboard electronic musical instruments provided separately from said accompaniment unit:

said first and second keyboard electronic musical instruments being connected to said accompaniment unit by means including said cable;

said second keyboard electronic musical instrument includes a second keyboard and means for generating a second control signal to be supplied to said accompaniment unit, said means for generating said second control signal including means for generating second key depression data according to a key operation on the second keyboard: and said accompaniment unit further includes:

means for receiving said second key depression data, means for generating second key depression pattern data according to said received second key depression data, means for discriminating a chord according to said second key depression data, and means for generating second accompaniment data designating a predetermined accompaniment tone according to the chord discriminated according to said second key depression data.

13. A hybrid electronic musical instrument, comprising:

a first electronic keyboard musical instrument including a first keyboard having a first key group and a second key group, and circuit means for executing a predetermined function according to operation of said first keyboard;

a second electronic keyboard musical instrument without said circuit means;

said second electronic musical instrument including:

a second keyboard having a first key group and a second key group;

means for generating a drive signal by operating a key on said second keyboard for driving said circuit means in said first electronic musical instrument; and means for supplying said drive signal to said circuit means of said first electronic musical instrument;

means for changing an operation mode of the hybrid electronic musical instrument, said operation mode including a first mode in which only said first electronic keyboard musical instrument is operated, a second mode in which only said second electronic keyboard musical instrument is operated and a third mode in which both of said first and second electronic keyboard musical instruments are operated together; and means for designating the function of the first and second key groups of said first and second keyboards in accordance with the operation mode of the first and second musical instruments, so that, in the first mode, only the first key group of the first keyboard is used to execute the predetermined function, in the second mode, no function designation is made in the first and second groups of the second keyboard, and in the third mode, no function designation is made in the first keyboard of the first musical instrument to execute the predetermined function, while one of the first and second key groups of the second keyboard is designated to execute the predetermined function;

said circuit means of said first electronic musical instrument executing said predetermined function according to said drive signal supplied from said second electronic musical instrument.

14. The hybrid electronic musical instrument according to claim 13, wherein said circuit means includes an auto-play accompaniment circuit means for automatically generating accompaniment tones as the predetermined function.

15. The hybrid electronic musical instrument according to claim 14, which further includes:

system switching means provided on either one of said first and second keyboard electronic musical instruments; and means for supplying a key signal from said second keyboard electronic musical instrument to said auto-play accompaniment circuit means of said first keyboard electronic musical instrument according to an output of said system switching means.

16. The hybrid electronic musical instrument according to claim 15, wherein said first keyboard electronic musical instrument includes:

accompaniment mode switching means;

means for generating a transfer control signal according to the output of said mode switching means and the output of said system swiching means; and first gate means gate controlled according to said transfer control signal for supplying the key signal from said second keyboard electronic musical instrument to said auto-play accompaniment circuit means of said first keyboard electronic musical instrument.

17. The hybrid electronic musical instrument according to claim 16, wherein said second keyboard electronic musical instrument includes:

means for receiving the transfer control signal from said first keyboard electronic musical instrument;

means for generating a split designation signal in response to said transfer control signal; and second gate means gate controlled according to said split designation signal for supplying said key signal to said first keyboard electronic musical instrument.

18. The hybrid electronic musical instrument according to claim 15, wherein said auto-play accompaniment circuit means includes chord discriminating means for discriminating a chord represented by said key signal and generating a predetermined accompaniment tone signal.

19. The hybrid electronic musical instrument according to claim 18, wherein said chord discriminating means includes a ROM accessed by said key signal.

* * * * *